United States Patent [19]

Tolley

[11] Patent Number: 4,944,096

[45] Date of Patent: Jul. 31, 1990

[54] WALL STUD CENTERING SQUARE

[76] Inventor: Sherman D. Tolley, Rt. 4, Box 3455, Elizabethton, Tenn. 37643

[21] Appl. No.: 406,024

[22] Filed: Sep. 11, 1989

[51] Int. Cl.[5] ..... B43L 7/06

[52] U.S. Cl. ..... 33/480; 33/451

[58] Field of Search ..... 33/32.1–32.7, 33/41.1, 41.6, 42, 43, 44, 404, 429, 438, 451, 452, 742, 480, 428, 379, 347, 41.4, 474, 666, 669, 670, 574, 578, 197, 562

[56] References Cited

U.S. PATENT DOCUMENTS

| | | | |
|---|---|---|---|
| 686,240 | 11/1901 | Whitehill | 33/474 |
| 784,079 | 3/1905 | Stempel | 33/429 |
| 799,474 | 9/1905 | Larson et al. | 33/429 |
| 964,785 | 7/1910 | Johnson | 33/43 |
| 3,169,320 | 2/1965 | Currie | 33/563 |
| 4,607,438 | 8/1986 | DeFrange | 33/562 |
| 4,693,011 | 9/1987 | Strayham | 33/451 |

*Primary Examiner*—Allan N. Shoap
*Assistant Examiner*—Daniel G. DePumpo
*Attorney, Agent, or Firm*—Leon Gilden

[57] ABSTRACT

A wall stud centering square is arranged for overlying centering marks premeasured along floor and ceiling plates of an associated wall. The tool defines a blade one and one-half inches wide to correspond to the width of existing wall studs with a center measurable slot to overlie premarked stud indicating lines preformed on wall and floor plates of a wall to be constructed. The blade is positioned upon the indicating mark and scribed along both side edges of the blade to provide a one and one-half inch wide indicator line for positioning of a wall stud.

2 Claims, 4 Drawing Sheets

FIG 1
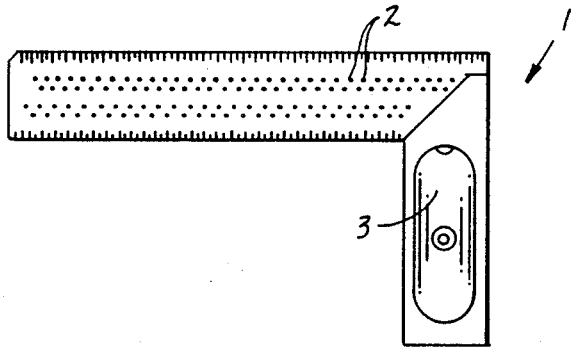
PRIOR ART
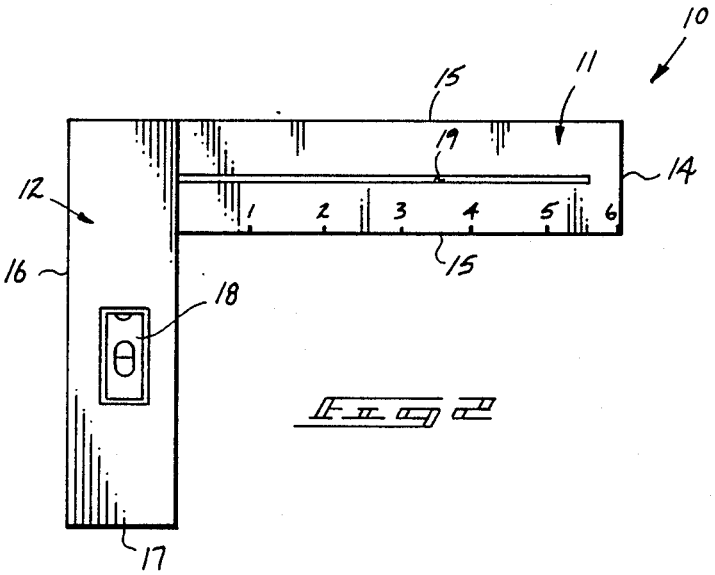
FIG 2

FIG 3
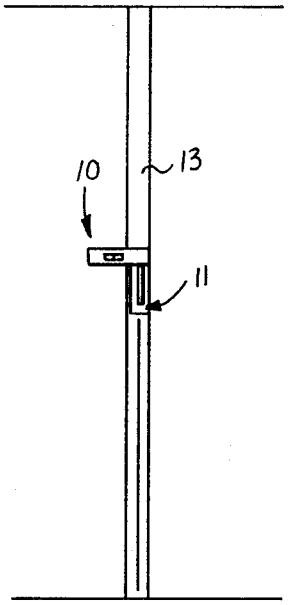
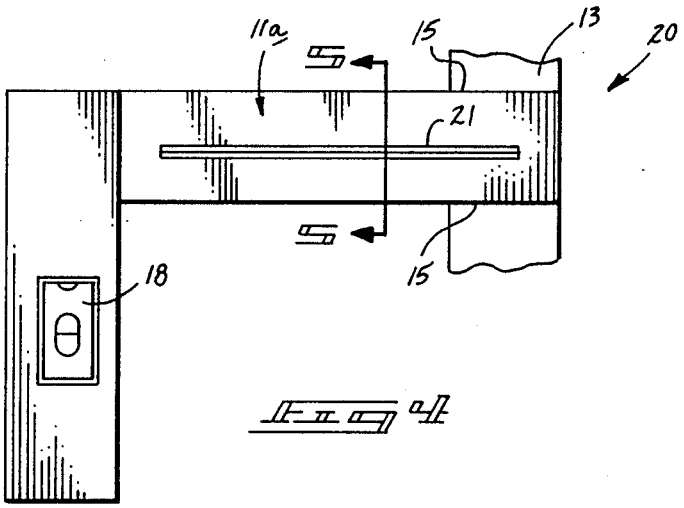
FIG 4

Fig 5
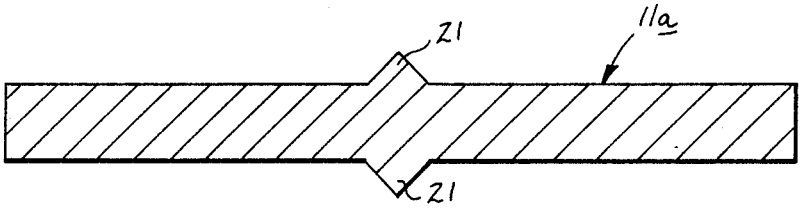
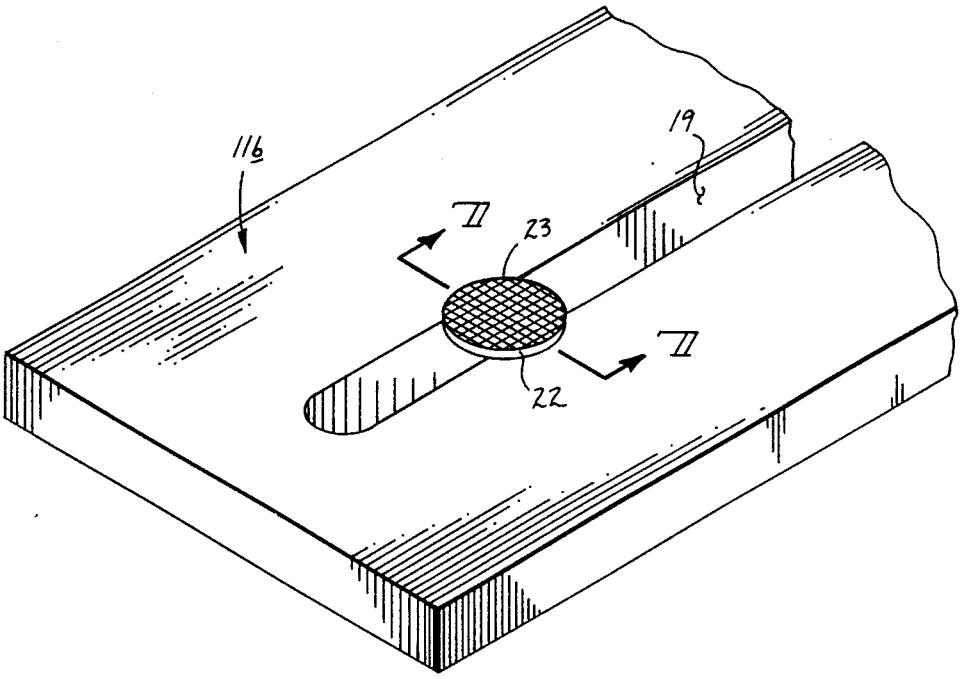
Fig 6

Fig 7
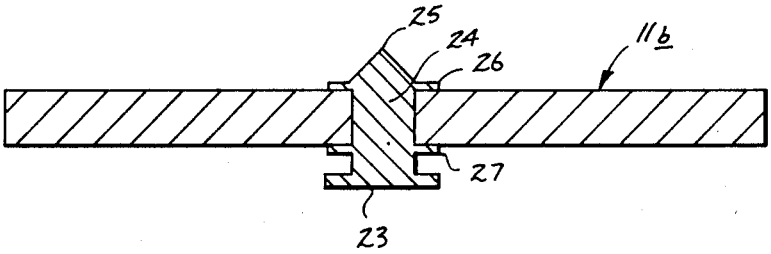
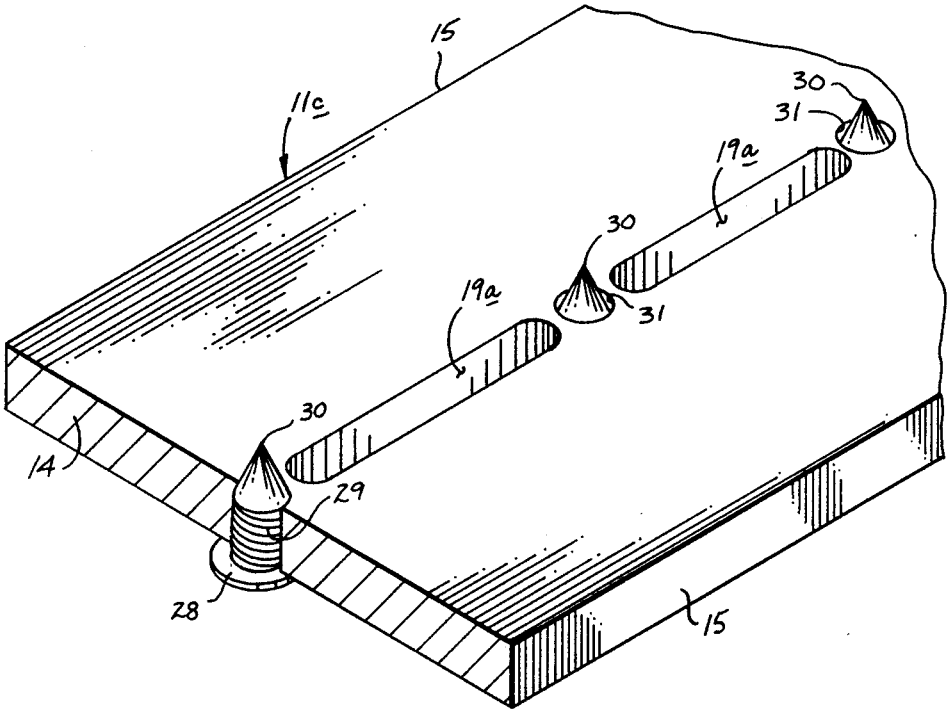
Fig 8

WALL STUD CENTERING SQUARE

BACKGROUND OF THE INVENTION

1. Field of the Invention

The field of invention relates to stud alignment tools, and more particularly pertains to a new and improved wall stud centering square wherein the same enables alignment of wall studs along floor and ceiling plates of a wall to be constructed.

2. Description of the Prior Art

The use of various "T" squares for a variety of applications is well known in the prior art. Heretofore, however, the positioning of studs has required the preindicating of sixteen inch centers, for example, of the wall studs, and thereafter measuring exteriorly of the so indicated mark for accommodation of the wall stud within the spaced marks. Examples of the prior art to accomplish this are exemplified by U.S. Pat. No. 4,503,624 to Whiteford setting forth a combination tool utilizing a bubble balance along one blade with a matrix of openings along another blade for alignment of the apertures with associated scales on each side of the blade.

U.S. Pat. No. 1,549,947 to Wolfe sets forth a centering tool wherein a plurality of fixed jaws are slidably movable relative to a blade to center and align a cylindrical workpiece therebetween.

U.S. Pat. No. 2,085,461 sets forth a combination rule and slidable head wherein the rule includes a bulb balance along one blade reciprocatably mounted relative to a second blade with a protractor head and "V" shaped centering head also slidably mounted along the rule for application to various workpieces.

U.S. Pat. No. 8,499,225 to Darrah sets forth a tool comprising a non-magnetic square including a magnetic means located along one leg of the tool with a scale formed upon the other leg.

U.S. Pat. No. 694,774 to Muehlberg sets forth a centering square utilizing a slidably mounted head positionable along the rule for use as a "T" square or as a parallel or circular scribe to overlie workpieces, particularly in a carpentry environment.

As such, it may be appreciated that there is a continuing need for a new and improved wall stud centering square wherein the same provides a tool of compact and convenient organization and addresses both the problems of ease of use and effectiveness in construction and in this respect, the present invention substantially fulfills this need.

SUMMARY OF THE INVENTION

In view of the foregoing disadvantages inherent in the known types of "T" squares now present in the prior art, the present invention provides a wall stud centering square wherein the same utilizes a first blade orthogonally mounted to a second blade, wherein the second blade includes an elongate slot for overlying an indicia mark for permitting scribing along exterior side edges of the second blade for premarking positions of wall studs. As such, the general purpose of the present invention, which will be described subsequently in greater detail, is to provide a new and improved wall stud centering square which has all the advantages of the prior art "T" square devices and none of the disadvantages.

To attain this, the present invention includes a first blade of elongate parallelepiped configuration with a centering bubble balance indicator positioned medially thereon for indicating a horizontal orientation of a floor plate or a stud member with a second blade orthogonally and fixedly secured to an upper end of the first blade, wherein the second blade includes an elongate slot medially directed of the blade terminating adjacent an end edge of the second blade. Modifications include knife edges positioned in lieu of the slot for providing anchoring and fixing of the second blade relative to a floor plate for stud measuring and indicating, wherein further modifications include a slide marker slidable within the slot for providing a marking of the centering of the stud to be aligned. Further, threaded positioning members may be received medially of the second blade for providing anchoring points therethrough for positioning the second blade relative to a floor plate or ceiling plate to be indicated for stud positioning.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will for the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wall stud centering square which has all the advantages of the prior art centering squares and none of the disadvantages.

It is another object of the present invention to provide a new and improved wall stud centering square which may be easily and efficiently manufactured and marketed.

It is a further object of the present invention to provide a new and improved wall stud centering square which is of a durable and reliable construction.

An even further object of the present invention is to provide a new and improved wall stud centering square which is susceptible of a low cost of manufacture with regard to both materials and labor, and which accordingly is then susceptible of low prices of sale to the consuming public, thereby making such wall stud centering squares economically available to the buying public.

Still yet another object of the present invention is to provide a new and improved wall stud centering square which provides in the apparatuses and methods of the prior art some of the advantages thereof, while simultaneously overcoming some of the disadvantages normally associated therewith.

Still another object of the present invention is to provide a new and improved wall stud centering square wherein the same permits visual alignment of an indicator mark of a floor plate or ceiling plate for permitting scribing and indicating of wall stud placement relative to the floor plate or ceiling plate of the wall to be constructed.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top orthographic view of a prior art "T" square.

FIG. 2 is a top orthographic view of the instant invention.

FIG. 3 is an orthographic view of the instant invention illustrating the width of the second blade in reference to a wall stud.

FIG. 4 is a top orthographic view of a further embodiment of the instant invention.

FIG. 5 is an orthographic view taken along the lines 5—5 of FIG. 4 in the direction indicated by the arrows.

FIG. 6 is an isometric illustration of a yet further embodiment of the second blade of the instant invention.

FIG. 7 is an orthographic view taken along the lines 7—7 of FIG. 6 in the direction indicated by the arrows.

FIG. 8 is an isometric illustration of a still further embodiment of the second blade of the instant invention.

DESCRIPTION OF THE PREFERRED EMBODIMENT

With reference now to the drawings, and in particular to FIGS. 1 to 8 thereof, a new and improved wall stud centering square embodying the principles and concepts of the present invention and generally designated by the reference numeral 10 will be described.

More specifically, the wall stud centering square 10 of the instant invention comprises an improvement over the prior art "T" square 1 utilizing a series of rows of apertures 2 for aligning an underlying mark with existing scales on each edge of the apertured blade.

FIG. 2 illustrates a top orthographic view of the instant invention wherein a first ruled blade 11 is orthogonally and integrally mounted to a second rule blade 12 at an upper end of the second rule blade 12, the first rule blade 11 is exactly one and one-half inches in width as measured along a first ruled end edge 14 and is of a length substantially equal to six inches. The second blade 12 is also one and one-half inches in width and five and one-half inches in length, as measured along the second rule elongate side edge 16 to the associated end of edge 17. The second rule blade 12 includes a bubble level indicator 18 mounted medially through an upper surface of the second blade 12. The width of the first and second blades are of particular significance in that they are exactly equal to the width of conventional 2×4 wall studding which measures also one and one-half inches in width, as illustrated in FIG. 3 for example. The first blade 11 includes an elongate medial viewing slot 19 formed through the first blade 11 and extending along the blade parallel to and medially of the side edges 15 and adjacent the first rule end edge 14. In use, the blade 11 is positioned overlying a wall stud 13 in an orientation, as illustrated in FIG. 3 for example, wherein the slot 19 enables visual observation of premarked indicia on the stud 13. Typically, these indicia are positioned along sixteen inch centers, as is conventional in contemporary wall construction. Upon positioning of the blade 11, with the slot 19 overlying the premarked indicia on the floor plate stud 13, the side edges 15 are scribed by a suitable tool, such as a pencil or a scribing instrument. Upon removal of the blade 11, a plurality of spaced scribes exactly one and one-half inches in width for indication of positioning of a wall stud thereon are inscribed upon the plate. The same operation is performed on a floor plate and thereby the spaced scribes enable positioning of a wall stud therebetween in sixteen inch centers, as required. If other centering spacings are desired, the procedure is the same, be it twelve, sixteen, or twenty-four inch centers for wall studs.

FIG. 4 is illustrative of a second embodiment 20 of the wall stud centering square tool wherein the modified first blade **11*a* includes a knife edge portion 21 including upwardly and downwardly extending knife edges for overlying indicia to anchor the first blade 11*a* in a predetermined orientation over an indicia for scribing on each elongate side 15** thereafter for marking of the stud to be positioned between such predescribed indicia.

FIG. 6 illustrates a second modified first rule blade **11*b* wherein a slide member 22 includes a serrated head 23, a shank 24, a pointed end 25 coaxially aligned with the shank 24, with lower and upper circular flanges 26 and 27 respectively capturing the sliding shank portion 24 within the slot 19 of the second modified rule 11*b*. The slide member 22 thereby enables anchoring of the pointed end 25 upon visual observation through the slot 19 of the indicia positioned thereunder on a floor plate stud 13**.

FIG. 8 is illustrative of a third first rule blade member **11*c*. The modified third rule blade member 11*c* includes positioning members 28, including threaded shanks 29 formed with axially aligned pointed end portions 30 received within threaded apertures 31 aligned medially of the modified second blade 11*c*, whereupon visual observation through separate viewing slots 19*a* aligned between the threaded apertures 31 enables positioning of the pointed end portions 80 overlying a floor or ceiling plate stud member 18 to anchor the tool to enable subsequent scribing of indicia lines along the sides 15 of the modified blade member 11*c***.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wall stud centering square comprising, a first rule blade member including a pair of opposed parallel longitudinal edges terminating in orthogonal first end edge, and an elongate second rule blade member connected to said first rule blade member at one end thereof orthogonally thereto, said second rule blade member including a plurality of opposed longitudinal edges, each disposed orthogonally relative to said longitudinal edges of said first rule blade member, and a bubble type liquid level indicator formed medially of said second rule blade member, and said first rule blade member including a positioning member formed longitudinally of and medially through the first rule blade member wherein the positioning member is coextensively formed within the first rule blade member medially of the longitudinal side edges of the first rule blade member and terminating to a position adjacent a remote free end of the first rule blade member, and wherein the positioning member includes a knife edge portion including a plurality of aligned knife edges portions extending above and below the first rule blade member, wherein the knife edges are positioned medially of the longitudinal side edges of the first rule blade member for anchoring the first rule blade member onto an underlying construction stud.

2. A wall stud centering square comprising, a first rule blade member including a pair of opposed parallel longitudinal edges terminating in orthogonal first end edge, and an upper surface spaced from a lower surface, and an elongate second rule blade member connected to said first rule blade member at one end thereof orthogonally thereto, said second rule blade member including a plurality of opposed longitudinal edges, each disposed orthogonally relative to said longitudinal edges of said first rule blade member, and a bubble type liquid level indicator formed medially of said second rule blade member, and said first rule blade member including a positioning member formed longitudinally of and medially through the first rule blade member wherein the positioning member is coextensively formed within the first rule blade member medially of the longitudinal side edges of the first rule blade member and terminating to a position adjacent a remote free end of the first rule blade member, and wherein the positioning member includes a series of threaded apertures, the threaded apertures equally spaced orthogonally through the first rule blade member and the upper and lower surfaces, and the threaded apertures including a threaded shank secured therein, each threaded shank including a pointed lower end extending beyond the lower surface and a coaxially aligned head portion positionable contiguously onto the upper surface, and further including a series of slots aligned between the threaded apertures.

* * * * *